US007254005B2

(12) United States Patent
Oyama

(10) Patent No.: US 7,254,005 B2
(45) Date of Patent: Aug. 7, 2007

(54) AC PLUG AND ELECTRICAL APPARATUS PROVIDED WITH SAME

(75) Inventor: Yoshiki Oyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 135 days.

(21) Appl. No.: 11/143,811

(22) Filed: Jun. 2, 2005

(65) Prior Publication Data

US 2005/0272292 A1 Dec. 8, 2005

(30) Foreign Application Priority Data

Jun. 8, 2004 (JP) ..... P2004-169835

(51) Int. Cl.
*H01H 47/00* (2006.01)

(52) U.S. Cl. ..... 361/220; 439/188

(58) Field of Classification Search ..... 361/220
See application file for complete search history.

(56) References Cited

U.S. PATENT DOCUMENTS

| | | | | |
|---|---|---|---|---|
| 3,120,632 | A * | 2/1964 | Hopt et al. | 320/107 |
| 3,821,639 | A * | 6/1974 | De Langis | 324/508 |
| 5,401,180 | A * | 3/1995 | Muzslay | 439/188 |
| 5,480,313 | A * | 1/1996 | d'Alayer de Costemore d'Arc | 439/159 |
| 5,490,033 | A * | 2/1996 | Cronin | 361/212 |
| 5,831,802 | A * | 11/1998 | Ahmed et al. | 361/1 |
| 6,771,477 | B2 * | 8/2004 | Milanczak | 361/104 |

FOREIGN PATENT DOCUMENTS

| | | |
|---|---|---|
| DE | 7916174 | 9/1979 |
| EP | 0632546 | 1/1995 |
| JP | 58-154575 | 9/1983 |
| JP | 04-081380 | 3/1992 |
| JP | 07-065889 | 3/1995 |
| JP | 11-177369 | 7/1999 |
| JP | 2000-301991 | 10/2000 |
| JP | 2002-260789 | 9/2002 |

OTHER PUBLICATIONS

Japanese Office Action issued on Sep. 5, 2006.

* cited by examiner

*Primary Examiner*—Ronald W. Leja
(74) *Attorney, Agent, or Firm*—Sonnenschein Nath & Rosenthal LLP

(57) ABSTRACT

An AC plug provided with a plug casing and prongs formed sticking out from the inside of the plug casing to the outside and supplying AC power supplied from a power outlet to the prongs by an AC cord connected to the prongs inside the plug when the prongs are inserted into the power outlet, further provided with, inside the plug casing in series between the prongs, a discharge resistor for discharging a residual charge across the prongs when the prongs are pulled out from the power outlet and a switch turning off when the prongs are inserted into the power outlet, turning on when they are pulled out from the power outlet to pass the residual charge of one prong of the prongs to the other prong through the discharge resistor.

7 Claims, 8 Drawing Sheets

PRESENT INVENTION

AC PLUG AND ELECTRICAL APPARATUS PROVIDED WITH SAME

CROSS REFERENCES TO RELATED APPLICATIONS

The present invention contains subject matter related to Japanese Patent Application No. 2004-169835 filed in the Japan Patent Office on Jun. 8, 2004, the entire contents of which being incorporated herein by reference.

BACKGROUND OF THE INVENTION

1. Field of Invention

The present invention relates to an AC plug for the supply of AC power supplied from a power outlet to prongs by an AC cord when inserting the prongs into the power outlet and to an electrical apparatus provided with that AC plug and AC cord.

2. Description of the Related Art

An input part of an electrical apparatus powered by a commercial AC power supply has been provided with a noise filter for suppressing noise flowing in from the commercial power line and noise conversely flowing out from the apparatus.

FIG. 8 is a view of an electrical apparatus provided with an AC plug. This electrical apparatus 100 is comprised of an apparatus body 101 provided with an internal circuit 102 and a noise filter 103 at a power input side of the circuit. The noise filter 103 is connected to an AC cord 110 supplying power to the apparatus body and has an AC plug 120 attached to its front. As an AC plug 120, normally a general one comprised of a plastic plug body provided with a pair of metal pieces (prongs) for connecting the two lines of the AC cord 110 is used.

When the AC plug 120 is inserted into a not shown power outlet supplying commercial AC power, power is supplied to the internal circuit 102 of the apparatus body 101 through the AC cord 110.

The noise filter 103 for removing noise at this time includes a noise-suppression capacitor C electrically connected between the lines of the AC cord 110 for preventing leakage of noise generated at the internal circuit 102 of the apparatus body 101 to the outside and further for preventing noise from the outside from being input to the internal circuit 102.

The noise-suppression capacitor C has a large capacitance of for example 1 μF from the need for suppressing noise due to electromagnetic interference (EMI). In this case, a considerably large amount of charge can build up.

Therefore, when pulling out the AC plug 120 from the power outlet, the charge built up at the noise-suppression capacitor C may be applied across the two prongs exposed at the front end of the AC plug 120. To reduce the discharge, a resistance (hereinafter "discharge resistor") is electrically connected between the two lines of the AC cord 110 inside the noise filter at the apparatus body 101 side.

The resistance value of the discharge resistor R must match with the capacitance between the lines of the AC cord 110 including that of the capacitor C for noise suppression. That is, electrical apparatuses using capacitors between power lines are regulated in many countries. For example, Japan's Electrical Appliance and Material Safety Law requires that the voltage across terminals of an AC plug (voltage across prongs) be no more than 45V one second after the power plug of the electrical apparatus is pulled out from the power outlet. There are similar regulations in other countries as well. In particular, in Europe and other regions where the voltage level of the commercial power supply is high, tougher regulations restrict electrical apparatuses so as to enable more reliable discharge of the prongs. Further, leakage of noise is also strictly governed in many countries.

However, the discharge resistor leads to an increase of the power consumption since it continues to be supplied with current while the AC plug 120 is plugged into the power outlet. In particular, in the standby state, the power consumption of the apparatus itself falls, but the amount of power consumed by the discharge resistor R is constant, so the ratio becomes sufficiently large.

To overcome this disadvantage, it is known to provide a switch inside the noise filter of the apparatus body to prevent wasted current flowing to the discharge resistor (for example, see Japanese Unexamined Patent Publication (Kokai) No. 11-177369). Further, a circuit configuration has been proposed for detecting on a circuit basis whether commercial power is being supplied from the AC plug and cutting off the discharge resistor when the commercial power is being supplied (for example, see Japanese Unexamined Patent Publication (Kokai) No. 2001-095261).

However, in the technology described in Japanese Unexamined Patent Publication (Kokai) No. 11-177369, if operation of the switch is forgotten, the charge will not be released. Further, the power consumption is liable to increase.

In the technology described in Japanese Unexamined Patent Publication (Kokai) No. 2001-095261, if the switch is not operated due to a malfunction of the circuit, the prongs will not be discharged. Further, if the switch is left on, the power consumption will increase, so a malfunction-free detection circuit is required. There would then be the disadvantage of that much higher a cost.

Further, if the discharge resistor is in the apparatus body far in distance from the location of electric shock, that is, the AC plug, even if discharge is started, a residual charge will remain for a while across the prongs at the front end of the AC plug. Therefore, the above-mentioned electrical apparatuses have been insufficiently designed from the viewpoint of reliable discharge.

SUMMARY OF THE INVENTION

It is desirable to provide an AC plug and electrical apparatus able to realize both reliable discharge and reduced waste of power consumption at a low cost.

The AC plug according to the present invention is an AC plug includes a plug casing and prongs formed sticking out from the inside of the plug casing to the outside and supplying AC power supplied from a power outlet to the prongs by an AC cord connected to the prongs inside the plug when the prongs are inserted into the power outlet, further includes, inside the plug casing in series between the prongs, a discharge resistor for releasing a residual charge across the prongs when the prongs are pulled out from the power outlet and a switch turning off when the prongs are inserted into the power outlet, turning on when they are pulled out from the power outlet to pass the residual charge of one prong of the prongs to the other prong through the discharge resistor.

Preferably, there is further a noise-suppression capacitor connected between the prongs inside the plug casing.

The electrical apparatus according to the present invention includes an electrical apparatus body, an AC cord for sending AC power to the electrical apparatus body, and an AC plug provided at the front end of the AC cord, wherein the AC plug has a plug casing, prongs formed sticking out from the inside to the outside of the plug casing and inserted into a power outlet when receiving AC power, a discharge resistor provided inside the plug casing and discharging residual charge of the prongs when the prongs are pulled out from the power outlet, and a switch connected in series with the discharge resistor between the prongs, turning off when the prongs are inserted into the power outlet, turning on when they are pulled out from the power outlet to pass the residual charge of one prong of the prongs to the other prong through the discharge resistor.

Preferably, there is further a noise-suppression capacitor connected between the prongs in the plug casing. Alternatively, preferably, there are further provided a first noise-suppression capacitor connected between the prongs inside the plug casing and a second noise-suppression capacitor connected between the lines of the AC cord led into the electrical apparatus body.

BRIEF DESCRIPTION OF THE DRAWINGS

These and other objects and features of the present invention will become clearer from the following description of the preferred embodiments given with reference to the attached drawings, wherein:

FIG. 7A is a graph of the relationship between a residual noise level and frequency in the case of removing noise by only a filter at an apparatus side as shown in FIG. 8, while

DESCRIPTION OF THE PREFERRED EMBODIMENTS

Preferred embodiments of the present invention will be described in detail below while referring to the attached figures.

First Embodiment

Figure 1:
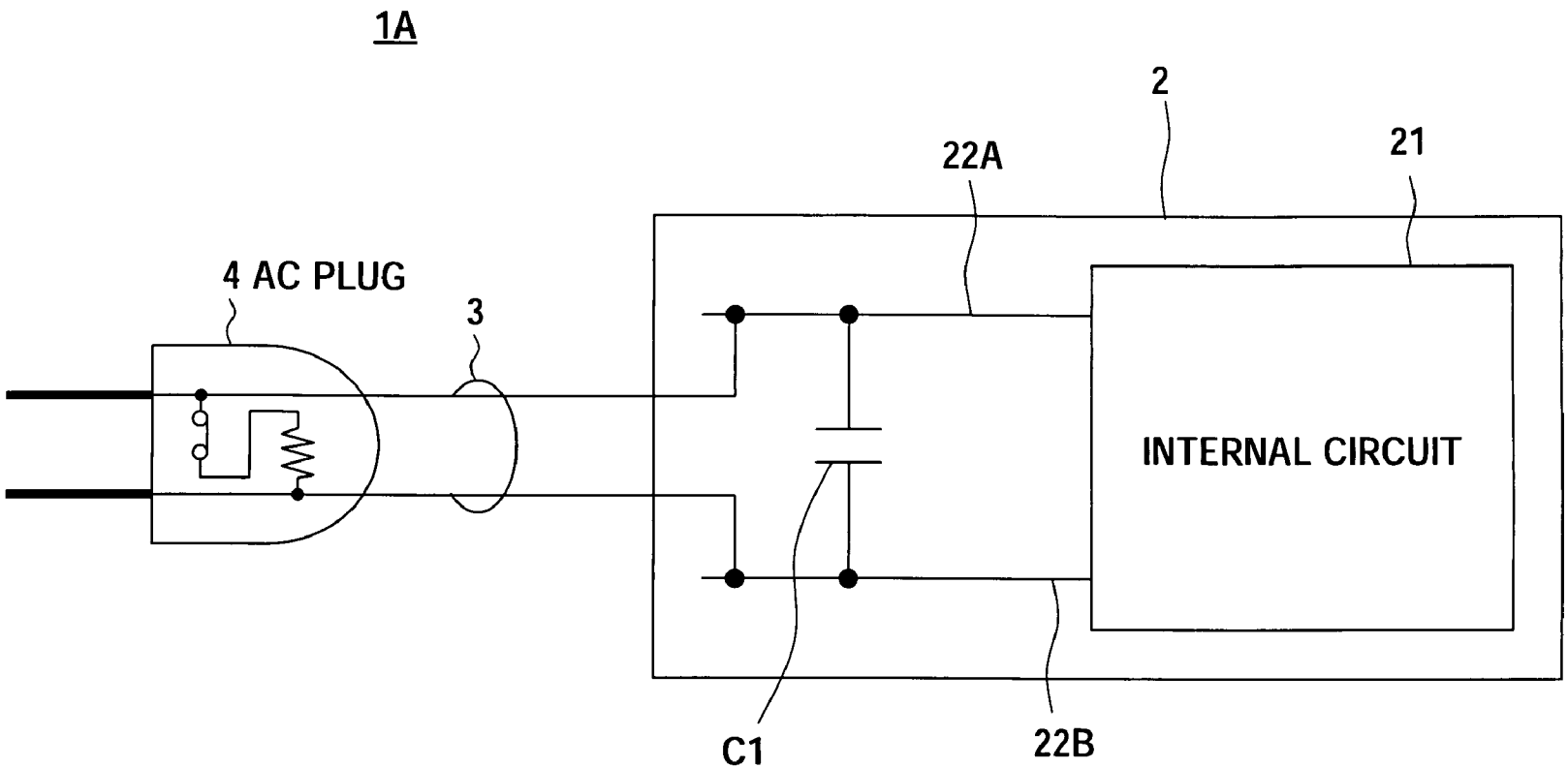
FIG. 1 is a view of an electrical apparatus according to a first embodiment of the present invention.

FIG. 1 shows an electrical apparatus according to a first embodiment of the present invention. The electrical apparatus 1 has an apparatus body 2, an AC cord 3 led into the apparatus body 2 for supplying the apparatus body 2 with AC power from the outside, and an AC plug 4 provided at the front end of the AC cord 3 at the outside of the apparatus body 2.

The detailed configuration will be omitted here, but the AC cord 3 is for example comprised of two parallel twisted wires covered by PVC etc. The AC cord 3 is connected inside the apparatus body 2 to power lines 22A and 22B in an internal circuit 21. At the power input side of the internal circuit 21, a noise-suppression capacitor C1 is connected between the power lines 22A and 22B. The capacitor C1 may be provided alone or may be provided as part of a power source noise filter. Whatever the case, here, only the noise-suppression capacitor C1 is shown at the power input side of the internal circuit 21. As the noise-suppression capacitor C1, for example, one of a large capacitance of 1 μF is required for the later-mentioned measures against EMI.

Figure 2:
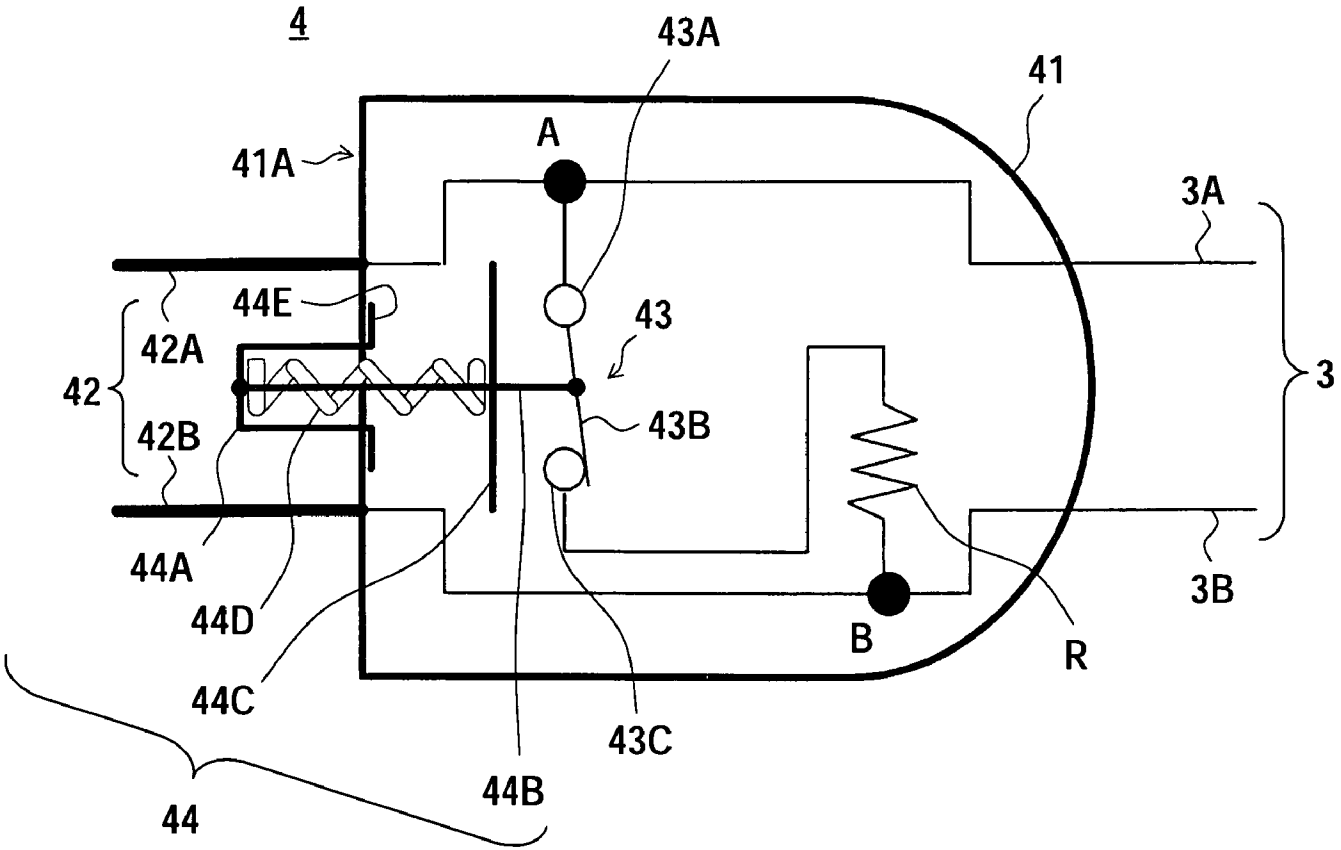
FIG. 2 is a view of the internal configuration of an AC plug.

FIG. 2 shows the internal configuration of an AC plug 4. The AC plug 4 has a plug casing 41 comprised of a plurality of casing parts made for example of plastic and formed with a space inside when fastening the plurality of casing parts together. The plug casing 41 holds a plurality of parts inside it. The AC plug 4 has, as parts fastened or held in the plug casing 41, the prongs 42 arranged sticking out from the inside to the outside of the plug casing 41, a switch 43 between the prongs 42 and its operating part 44, and a discharge resistor R. The resistance of the discharge resistor R is usually several hundred kΩ to several MΩ.

Note that the "prongs" 42 are the parts inserted into a power outlet as explained later.

The AC cord 3 is comprised of two parallel lines 3A and 3B. The prongs 42 are comprised of two prongs 42A and 42B. The line 3A and electrode 42A and the cord 3B and electrode 42B are connected inside the plug casing 41.

The switch 43 and discharge resistor R are connected in series between a plug contact A between the prong 42A and the line 3A and a plug contact B between the prong 42B and the line 3B. The switch 43 is provided with a fulcrum 43A electrically connected to the plug contact between the electrode 42A and the line 3A, a conductive operating piece 43B operating centered about the fulcrum 43A, and a contact 43C controlled in electrical connection state with the fulcrum 43A through the operating piece 43B. A discharge resistor R is connected between the contact 43C of the switch and the plug contact B between the prong 42B and line 3B. Note that the discharge resistor R may also be connected between the switch contact 43A and the plug contact A.

The operating piece 44 is provided with a movable projection 44A, a connecting pin 44B, a stopper 44C, and a spring 44D. The movable projection 44A projects out from the insertion-side surface 41A of the plug casing 41 where the prongs 42 are provided and can move in a direction substantially perpendicular to the insertion-side surface 41A. Note that the movable projection 44A may be provided anywhere at the insertion-side surface 41A, but provision between the prongs 42 is desirable in the sense of linkage with the plug insertion operation and guarantee of reliable operation.

More preferably, the movable projection 44A operates by its body part sliding in a hole (not shown) formed at the insertion-side surface 41A. At this time, the movable projection 44A is prevented from detaching from the plug casing 41 by provision of an abutting part 44E abutting against the inside of the plug of the insertion-side surface 41A at the circumference of the inside end of the body of the movable projection 44A. The abutting part 44E restricts movement of the movable projection 44A when it abuts against the stopper 44C fastened to the plug casing 41 at the inside of the plug. Therefore, the movable projection 44A freely slides in the stroke between the insertion-side surface 41A and the stopper 44C of the AC plug 4.

The front end surface of the movable projection 44A is closed. The back surface comprised of the closed end surface at the inside of the body and the stopper 44C are provided between them with a stopper 44D serving as the biasing means for providing force separating the two. FIG. 2 shows a spring 44D comprised of a coil spring, but it may also be a leaf spring or other type of spring or other biasing means. Further, the abutting part 44E and insertion-side surface 41A may also be provided between them with a spring or other biasing means for providing force joining the two.

The closed end surface of the movable projection 44A and the operating piece 43B of the switch 43 are connected by a connecting pin 44B. The movable projection 44A and the operating piece 43B of the switch are connected by the connecting pin 44B. Therefore, the switch 43 is operated linked with the sliding of the movable projection 44A.

In FIG. 2, the connecting pin 44B is passed through the axis of the coil spring 44D and a pin hole provided in the stopper 44C, whereby it is guided at the time of sliding. By being guided in this way, the connecting pin 44B will not tilt much with respect to the insertion-side surface 41A at the time of sliding. In this structure of the operating part 44, there is the advantage that the switch can be operated reliably.

However, the switch 43 is a single-sided contact type, so the operating piece 43B rotates about the fulcrum 43A. Therefore, along with the axial rotation of the operating piece 43B, the connecting pin 44B is allowed to tilt slightly with respect to the insertion-side surface 41A. Further, the operating piece 43B and the connecting pin 44B are axially supported to be able to rotate to a certain extent.

Note that it is also possible to configure the plug so as not to allow such rotation, that is, to make the switch 43 a two-contact type and make the operating piece 43 move in parallel in the sliding direction of the connecting pin 44B. In this case, the operating piece 43B and the connecting piece 44B do not rotate and can be fixed in place. Further, the operating piece 43B may also be provided with a biasing means.

Due to this switch 43 and its operating piece 44, when the AC plug 4 is inserted into the power outlet etc., the movable projection 44A is pushed to the inside of the plug by the outside surface of the power outlet.

Figure 3:
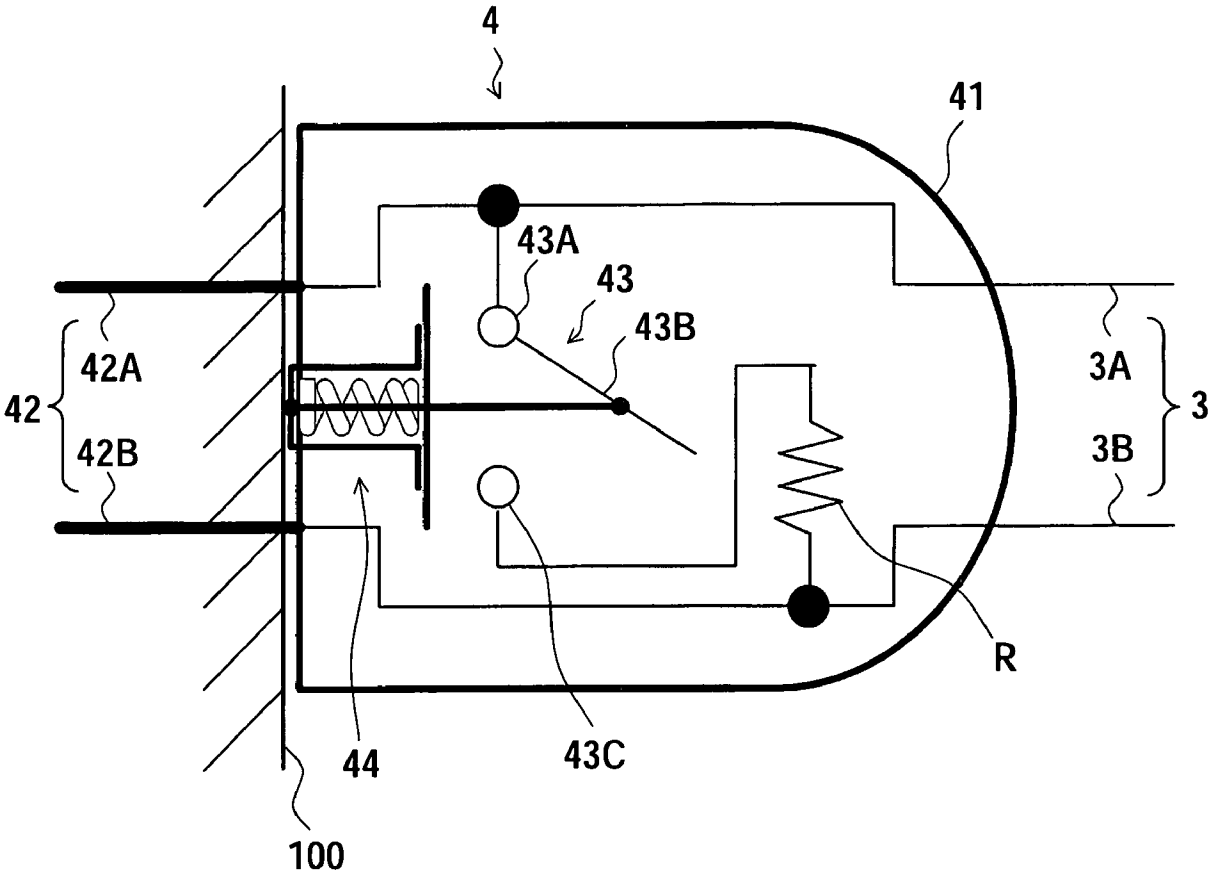
FIG. 3 is a view of the state of an AC plug inserted into a power outlet.

FIG. 3 shows the state of the AC plug 4 inserted into a power outlet. Note that the power outlet in which the AC plug 4 is inserted may be any of a power outlet provided at a wall of a room of a building, a power outlet of another apparatus, a power outlet of a table tap attached to another AC cord, etc.

When the prongs 42 of the AC plug 4 are inserted into the power outlet slots provided at the outside surface 100 of the power outlet, the movable projection 44A provided at the insertion-side surface 41A abuts against the outside surface 100 of the power outlet, the movable projection 44A slides to the inside of the plug, and the connecting pin 44B slides along with this. At this time, in the state with the prongs 42 of the AC plug 4 inserted to an extent of sufficient electrical connection with the plug receptacles (not shown) in the power outlet slots, the sliding of the movable projection 44A and the connecting pin 44B separates the operating piece 43B of the switch 43 from the contact 43C and turns off the switch 43.

Therefore, the discharge resistor R in the AC plug 4 is separated from one of the prongs 42, here, the electrode 42A. Therefore, the AC power supplied from the power outlet side by the prongs 42 is no longer wastefully consumed by the discharge resistor R. Note that FIG. 3 shows the state of the AC plug 4 completely inserted to the deepest point. At this time, the spring 44D causes a force to constantly act on the power outlet in a direction pulling the plug out. Therefore, the spring 44D employed is one of a weak spring force enough to make the movable projection 44A slide after the plug is pulled out from the power outlet.

From the state shown in FIG. 3, if pulling out the AC plug 4 from the power outlet, the process opposite to the above is followed to turn on the switch 43 at the state when the prongs 42 are sufficiently pulled out from the plug receptacles (not shown) in the power outlet. By pulling out the AC plug 4 from the power outlet, the pressing force on the movable projection 44A is released, so the movable projection 44A is returned to its original state by the force of the spring 44D.

Due to this, the discharge resistor R is electrically connected between the prongs 42. As shown in FIG. 1, the charge at the noise-suppression capacitor C1 attached between the power lines 22A and 22B inside the apparatus body 2 is released.

Note that in this embodiment, the charge is released at the AC plug 4 side where electric shock is a concern, so this is effective for reliable discharge of the prongs. That is, when providing a discharge resistor inside the apparatus body 2 unlike in the present embodiment, for a slight time from the start of discharge even after the side supplying the stored charge, that is, the AC plug 4, is completely pulled out, the charge will sometimes remain at the noise-suppression capacitor C1. In the present embodiment, the charge is released at the AC plug 4 side. This is effective for reliable discharge of the prongs. Further, since a simple mechanical switch 43 is added, the increase in cost due to this is slight. Compared with provision of an electrical switch in the electrical apparatus, it rather becomes possible to reduce the cost.

Note that to start the discharge at as early a stage as possible, it is sufficient to speed up the timing at which the switch 43 turns on in the range of sliding of the movable projection 44. However, unless the switch 43 is turned on at the stage when the prongs 42 of the switch 43 are fully pulled out from the plug receptacles in the power outlet, the AC current will short. Due to the above, in this embodiment, it is desirable to turn on the switch 43 as quickly as possible at the stage when the prongs 42 are sufficiently pulled out from the plug receptacles in the power outlet so as to prevent a short circuit.

Note that in this embodiment, the lack of a discharge resistor R in the apparatus body 2 is also a characterizing feature. This is because if providing a discharge resistor R at the apparatus body side 2, wasted power consumption occurs at all times in the state with the AC plug 4 inserted into the power outlet, and the effect of the present embodiment of the turning off switch 43 inside the AC power outlet 4 and reducing the wasted power consumption at the time of standby or stopping of the apparatus can no longer be obtained.

Second Embodiment

Figure 4:
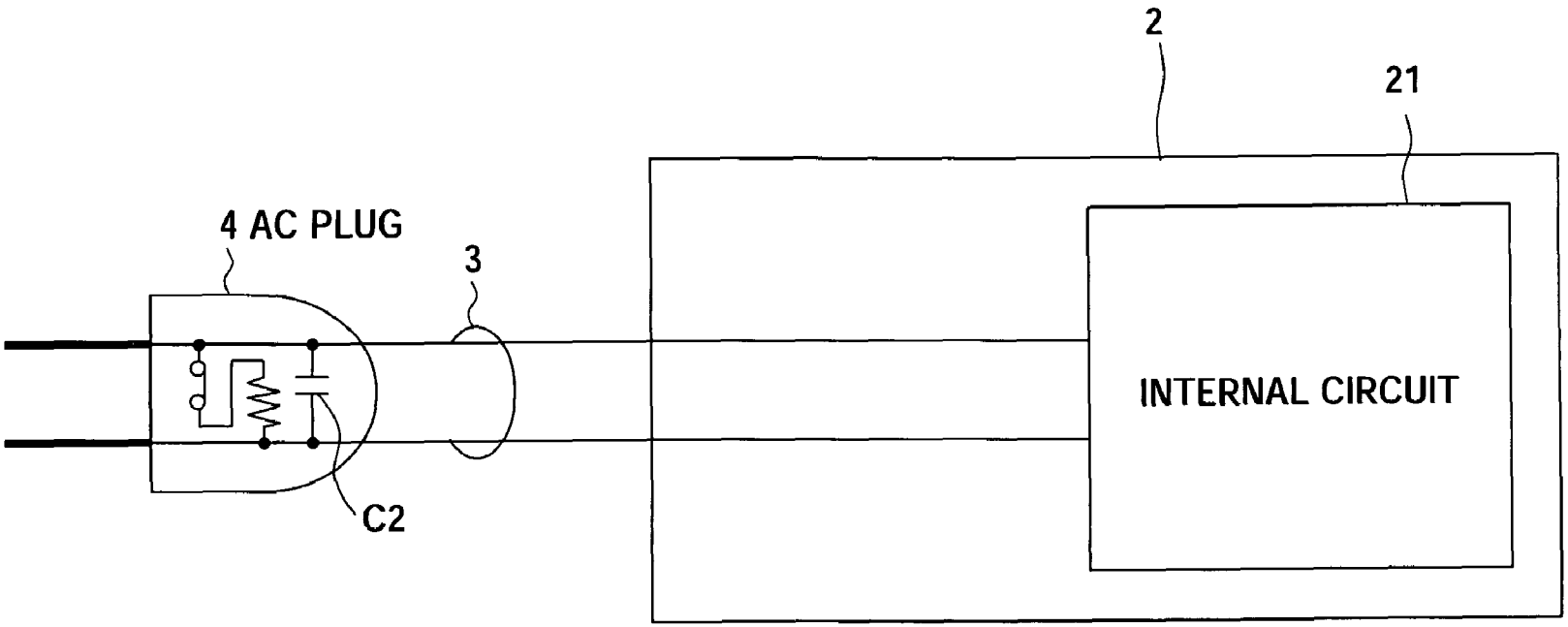
FIG. 4 is a view of an electrical apparatus according to a second embodiment of the present invention.
Figure 5:
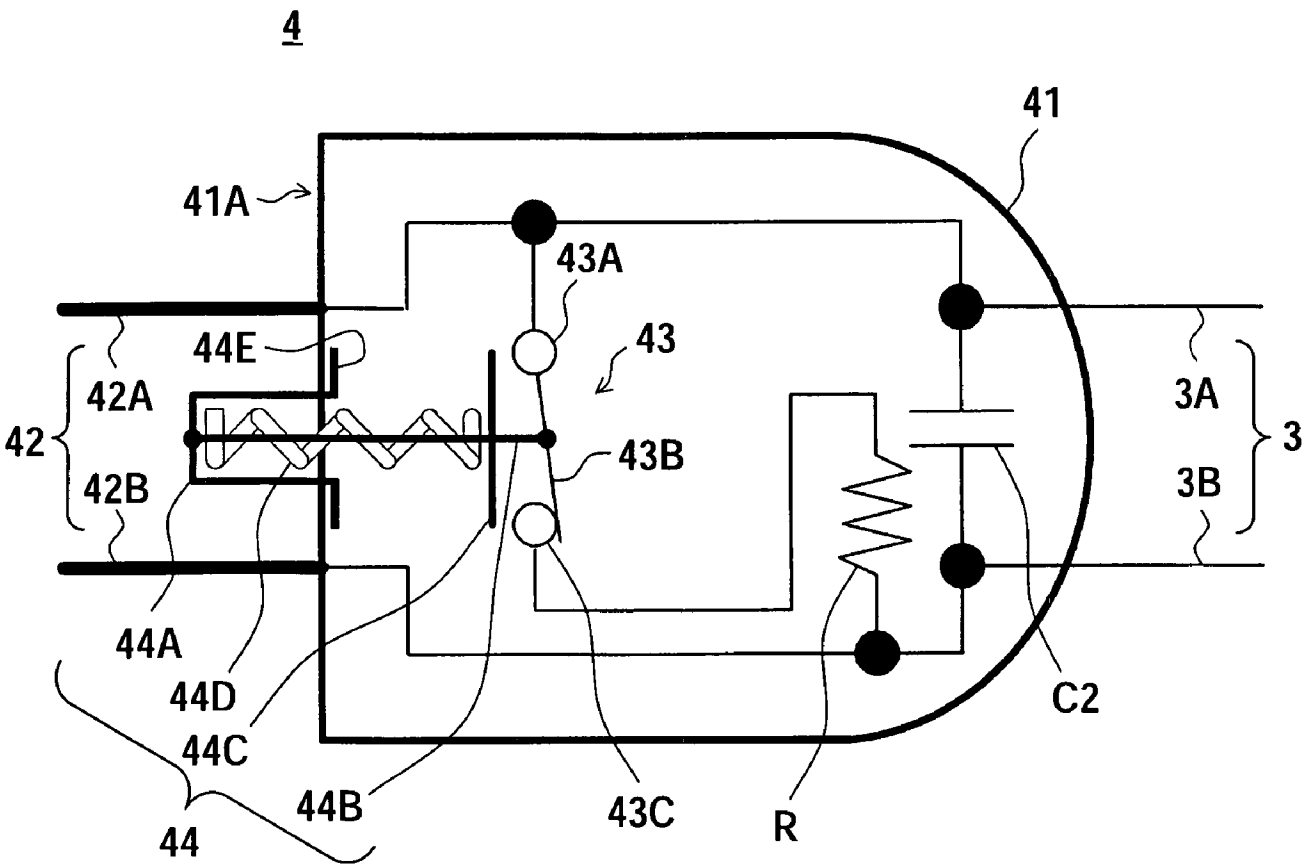
FIG. 5 is a view of the configuration of an AC plug according to a second and third embodiment.

FIG. 4 shows an electrical apparatus according to a second embodiment of the present invention, while FIG. 5 shows the configuration of the AC plug. In the second embodiment, the noise-suppression capacitor is provided not at the apparatus body 2 side, but in the AC plug 4. That is, as shown in FIG. 5, the noise-suppression capacitor C2 is connected between the lines 3A and 3B forming the AC cord 3. The rest of the configuration is the same as in FIG. 2, so the explanation will be omitted here.

In the embodiment shown in FIG. 1, when noise due to EMI etc. enters the AC cord 3 from the apparatus body 2, this noise jumps across the noise-suppression capacitor C1 and enters the AC cord 3 serving as an antenna, so cannot be eliminated by the capacitor C1. If noise enters the AC cord 3 in this way, when another apparatus is connected through the AC plug 4, the noise enters its power line resulting in unstable power potential and in the worst case mistaken operation.

In the second embodiment, the transmission of the noise to the power outlet side can be eliminated by the noise-suppression capacitor C2 in the AC plug 4, so there is the advantage that a high noise-suppression capability can be obtained even if using parts of the same performance. Therefore, as the capacitor C2, one having a large capacitance of for example about 1 μF is used. Note that the effect of reliable discharge of the prongs at low cost by control of connection of the discharge resistor R of the switch 43 is the same as in the first embodiment.

Third Embodiment

Figure 6:
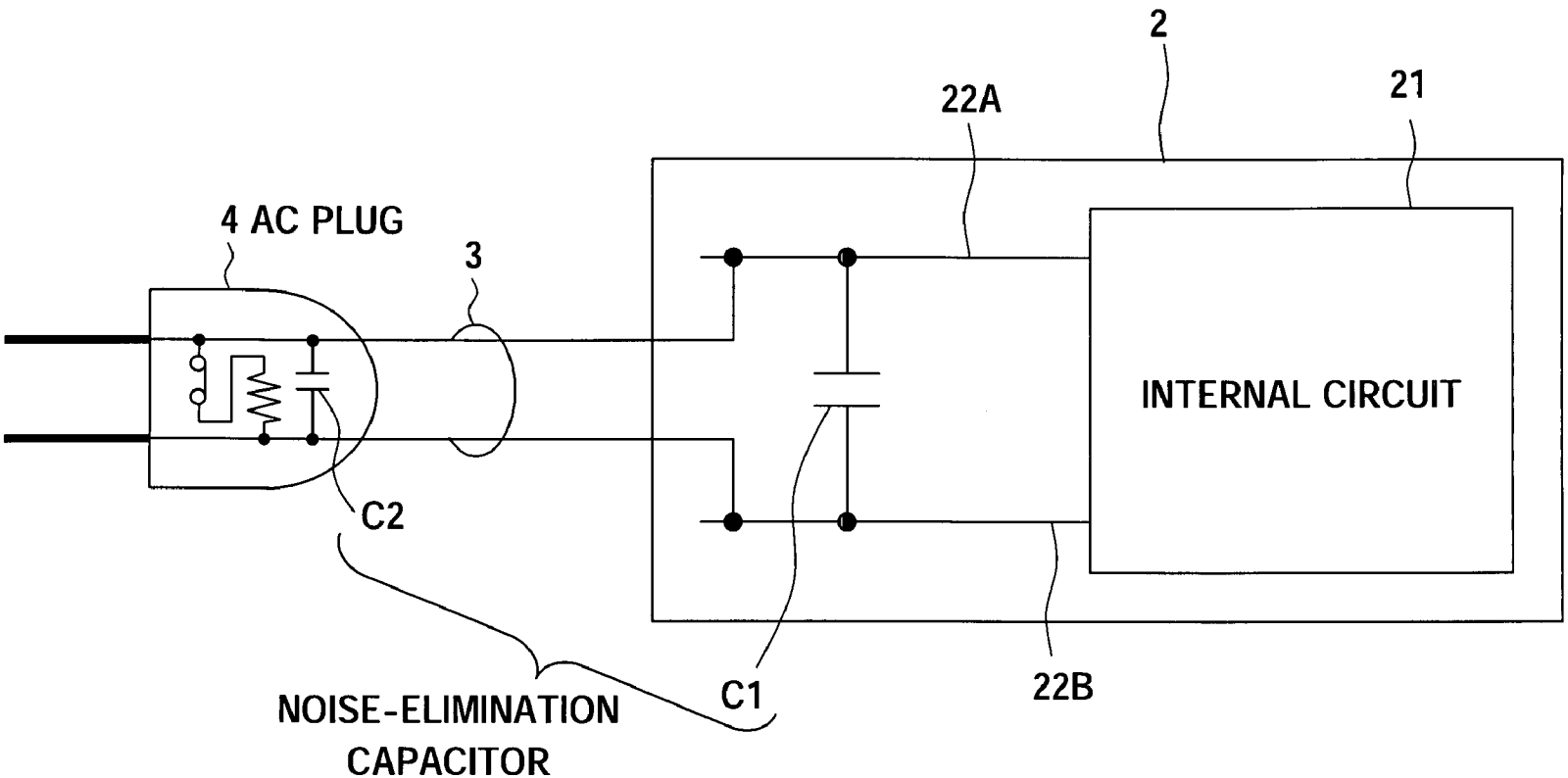
FIG. 6 is a view of an electrical apparatus according to a third embodiment of the present invention.

FIG. 6 shows an electrical apparatus according to a third embodiment of the present invention. In the third embodiment, in the same way as the second embodiment, a noise-suppression capacitor C2 is provided at the AC plug 4 side (see FIG. 5) and in the same way as the first embodiment, a noise-suppression capacitor C1 is provided at the power lines 22A and 22B in the apparatus body 2.

The AC plug 4 is required to be reduced in size, so in general not that large a capacitor C2 can be built in. Therefore, it is preferable to provide a small-sized capacitor C2 resistant to noise and superior in high frequency characteristics in the AC plug 4. However, when noise of not that high a frequency, but a large amplitude enters the apparatus body 2 from the power outlet side to the AC cord 3, sometimes it is not possible to completely remove the noise by just the capacitor C2 in the AC plug 4. Therefore, in this embodiment, a noise-suppression capacitor C1 is also provided at the apparatus body 2 side.

Further, the noise from other apparatuses is liable to enter the AC cord 3 and be transmitted to the internal circuit 21 in the apparatus body 2. To prevent the effects of such noise, it is necessary to provide the apparatus body 2 side with a capacitor C1 as a part of the filter in order to obtain a superior performance in eliminating low frequency noise and radiated noise.

In the third embodiment, in addition to effects similar to the first embodiment, by providing the noise-suppression capacitors at both of the apparatus body 2 side and the AC plug side, the effect is obtained of eliminating the noise on the AC cord 3 in the same way as the second embodiment and preventing mistaken operation of the apparatus connected to the power outlet side. Further, simultaneously, it is possible to effectively prevent both the noise on the AC cord 3 emitted from another apparatus and the noise of low frequency and large amplitude transmitted through the AC cord 3 from being transmitted to the internal circuit 21 of the apparatus body 2. Further, there are the advantages that a small sized AC plug can be realized even with a built-in capacitor type and the improvement of the noise-suppression ability enables simplification of the configuration of the noise filter inside the apparatus body 2 and reduction of the cost.

Figure 7A:
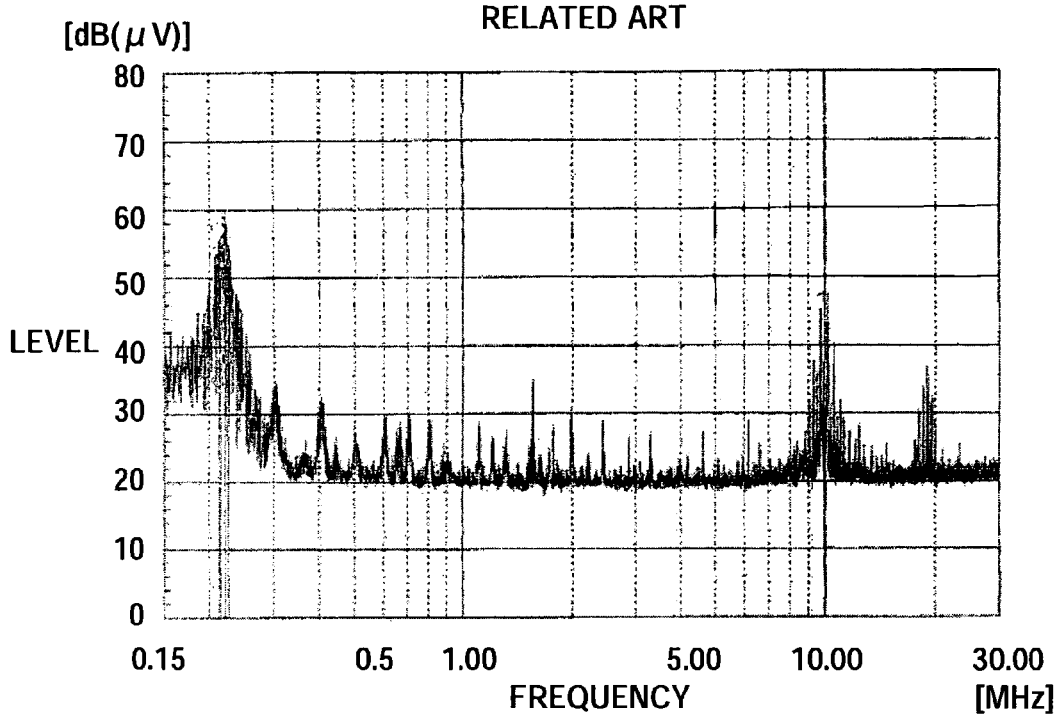
FIG. 7A RELATED ART
Figure 7B:
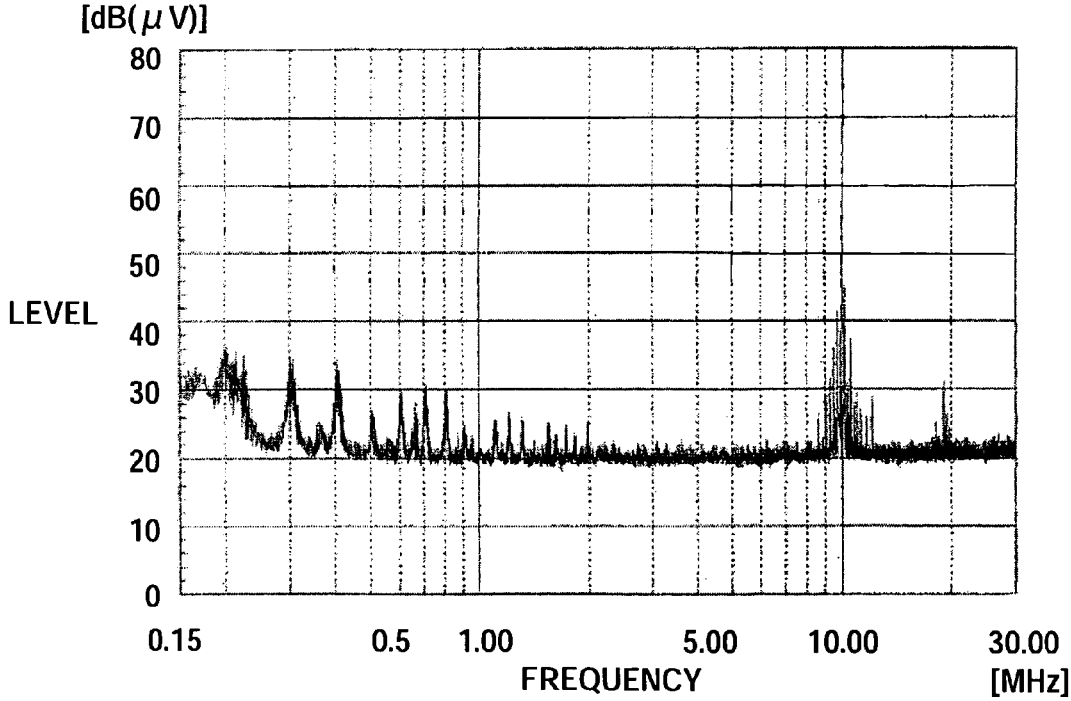
FIG. 7B is a similar graph in a third embodiment.
Figure 8:
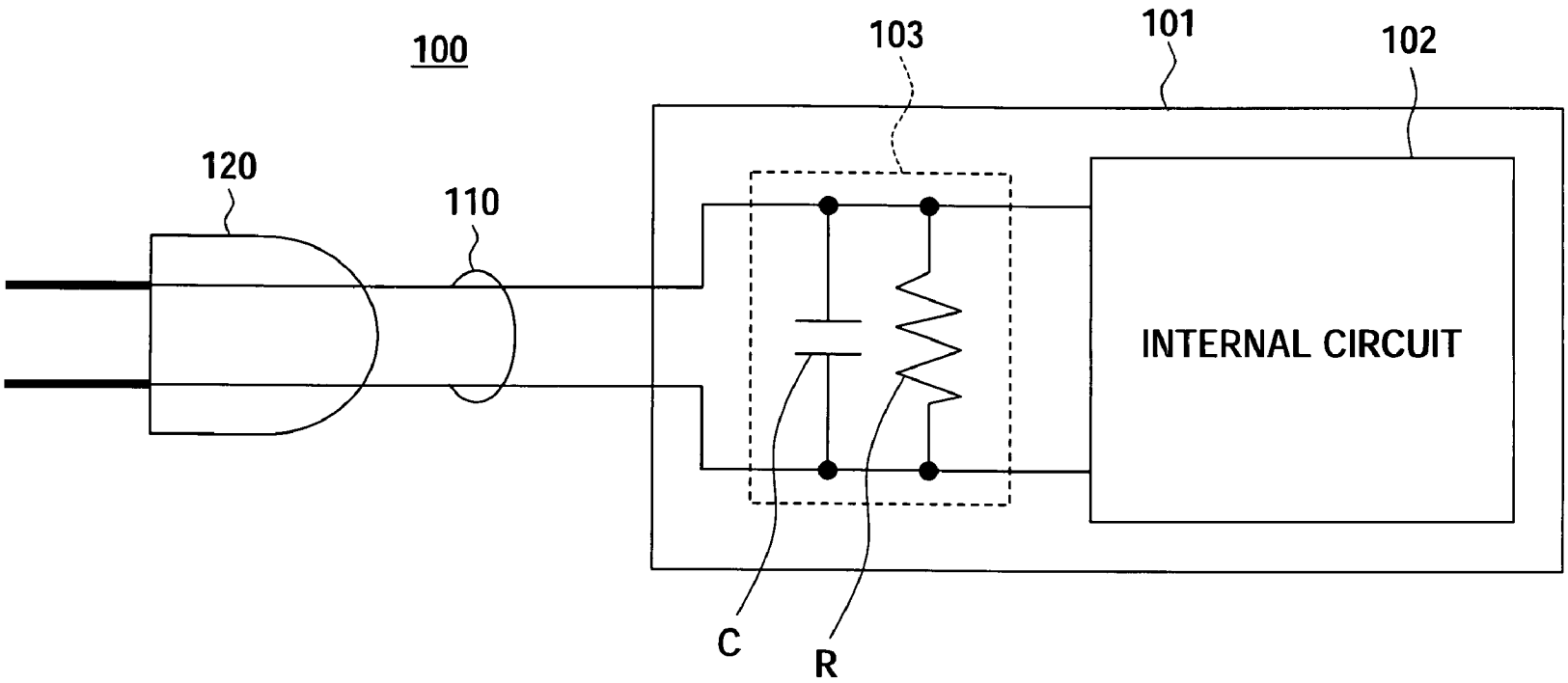
FIG. 8 is a view of an electrical apparatus provided with a AC plug.

FIGS. 7A and 7B are graphs showing the improvement in the noise-elimination function. FIG. 7A is a graph of the relationship between the residual noise level and the frequency in the case of removing noise by just a filter at the apparatus body side as shown in FIG. 8, while FIG. 7B is a graph of the third embodiment.

As clear from a comparison of FIGS. 7A and 7B, if providing the noise-elimination capacitors C1 and C2 at both of the apparatus body 2 side and AC plug 4 as in the third embodiment, it could be confirmed that the high frequency noise level was suppressed overall and the noise with the large low frequency level could be effectively removed.

While the invention has been described with reference to specific embodiments chosen for purpose of illustration, it should be apparent that numerous modifications could be made thereto by those skilled in the art without departing from the basic concept and scope of the invention.

What I claim is:

1. An AC plug comprising:

a plug casing;

prongs sticking out from the inside of the plug casing to the outside and configured to plug into an AC power outlet so that AC power can be supplied to an AC cord connected to the prongs inside the plug casing when the prongs are inserted into the power outlet;

a discharge resistor and switch inside the plug casing and connected in series between the prongs, the discharge resistor discharging a residual charge across the prongs when the prongs are pulled out from the power outlet, the switch switching to an open connection state when the prongs are inserted into the power outlet, the switch switching to a made connection state when the prongs are pulled out from the power outlet and to pass the residual charge of one prong to the other prong through the discharge resistor.

2. An AC plug as set forth in claim 1, wherein said switch has:

a movable projection at a surface of said plug casing from which the prongs project, the movable projection being pushed by a surface of the power outlet to move toward the inside of the plug casing when the prongs are inserted into the power outlet;

a connecting part connecting the movable projection and an operating piece of the switch but separating the operating piece from a contact of the switch by movement of the movable projection toward the inside of the plug casing; and a biasing means biasing the movable projection toward the outside of the plug casing.

3. An AC plug as set forth in claim 1, further comprising a noise-suppression capacitor connected in series between the prongs inside the plug casing.

4. An electrical apparatus comprising an electrical apparatus body, an AC plug; and an AC cord interconnecting the electrical apparatus body and the AC plug for sending AC power to the electrical apparatus body from the AC plug, wherein the AC plug has:

a plug casing;

prongs sticking out from the inside to the outside of the plug casing and configured to be inserted into an AC power outlet;

a discharge resistor inside the plug casing and operatively connected in series between the prongs to discharge residual charge on the prongs when the prongs are pulled out from the power outlet; and a switch connected in series between the discharge resistor and the prongs, the switch switching to an open connection state when the prongs are inserted into the power outlet, the switch switching to a closed connection state when the prongs are pulled out from the power outlet to pass the residual charge of one of the prongs to the other prong through the discharge resistor.

5. An electrical apparatus as set forth in claim 4, wherein said switch has:

a movable projection at a surface of said plug casing from which the prongs projects, the movable projection being pushed by a surface of the power outlet to move toward the inside of the plug casing when the prongs are inserted into the power outlet;

a connecting part connecting the movable projection and an operating piece of the switch but separating the operating piece from a contact of the switch by movement of the movable projection toward the inside of the plug casing; and a biasing means biasing the movable projection toward the outside of the plug casing.

6. An electrical apparatus as set forth in claim 4, further, comprising a noise-suppression capacitor connected in series between the prongs in the plug casing.

7. An electrical apparatus as set forth in claim 4, further, comprising:

a first noise-suppression capacitor connected in series between the prongs inside the plug casing and a second noise-suppression capacitor inside the electrical apparatus body and connected in series between power lines of the AC cord.

* * * * *